US011732532B2

(12) United States Patent
Cao et al.

(10) Patent No.: US 11,732,532 B2
(45) Date of Patent: Aug. 22, 2023

(54) METHODS OF FORMING CUTTING ELEMENTS

(71) Applicant: Baker Hughes, a GE company, LLC, Houston, TX (US)

(72) Inventors: Wanjun Cao, The Woodlands, TX (US); Xu Huang, Spring, TX (US); Steven W. Webb, The Woodlands, TX (US); Bo Yu, Spring, TX (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 570 days.

(21) Appl. No.: 16/790,574

(22) Filed: Feb. 13, 2020

(65) Prior Publication Data

US 2020/0181984 A1 Jun. 11, 2020

Related U.S. Application Data

(62) Division of application No. 15/977,205, filed on May 11, 2018, now Pat. No. 10,577,869, which is a (Continued)

(51) Int. Cl.

| | |
|---|---|
| ***B22F 3/24*** | (2006.01) |
| ***B22F 5/00*** | (2006.01) |
| ***C22C 26/00*** | (2006.01) |
| ***C22C 29/06*** | (2006.01) |
| ***B22F 3/14*** | (2006.01) |
| ***B22F 7/08*** | (2006.01) |

(Continued)

(52) U.S. Cl.

CPC ..... *E21B 10/60* (2013.01); *B22F 3/24* (2013.01); *B22F 5/00* (2013.01); *C22C 26/00* (2013.01); *C22C 29/06* (2013.01); *B22F 3/14* (2013.01); *B22F 7/08* (2013.01); *B22F 2003/244* (2013.01); *B22F 2005/001* (2013.01); *B22F 2302/406* (2013.01); *B22F 2998/10* (2013.01); *B22F 2999/00* (2013.01); *E21B 10/42* (2013.01); *E21B 10/567* (2013.01)

(58) Field of Classification Search

CPC ..... E21B 10/567; E21B 10/42; E21B 10/43; E21B 10/60; B22F 3/24; B22F 5/00; B22F 3/14; B22F 7/08; B22F 2003/244; B22F 2005/001; B22F 2302/406; B22F 2998/10; B22F 2999/00; C22C 26/00; C22C 29/06

See application file for complete search history.

(56) References Cited

U.S. PATENT DOCUMENTS 4,224,380 A 9/1980 Bovenkerk et al.
5,127,923 A 7/1992 Bunting et al.
(Continued)

FOREIGN PATENT DOCUMENTS

CN 104763347 A 7/2015

*Primary Examiner* — Anthony M Liang
*Assistant Examiner* — Danny N Kang
(74) *Attorney, Agent, or Firm* — TraskBritt

(57) ABSTRACT

A cutting element comprises a supporting substrate, a cutting table comprising a hard material attached to the supporting substrate, and a fluid flow pathway extending through the supporting substrate and the cutting table. The fluid flow pathway is configured to direct fluid delivered to an outermost boundary of the supporting substrate through internal regions of the supporting substrate and the cutting table. A method of forming a cutting element and an earth-boring tool are also described.

4 Claims, 11 Drawing Sheets

Related U.S. Application Data division of application No. 62/507,567, filed on May 17, 2017.

(51) Int. Cl.

| | |
|---|---|
| ***E21B 10/60*** | (2006.01) |
| *E21B 10/567* | (2006.01) |
| *E21B 10/42* | (2006.01) |

(56) References Cited

U.S. PATENT DOCUMENTS

| | | | | |
|---|---|---|---|---|
| 5,316,095 | A | 5/1994 | Tibbitts | |
| 5,590,729 | A | 1/1997 | Cooley et al. | |
| 5,678,645 | A | 10/1997 | Tibbitts et al. | |
| 6,986,297 | B2 | 1/2006 | Scott | |
| 2009/0274897 | A1* | 11/2009 | Kaner | C01B 35/04 51/307 |
| 2010/0314176 | A1 | 12/2010 | Zhang et al. | |
| 2017/0204672 | A1 | 7/2017 | Yu et al. | |
| 2017/0204674 | A1 | 7/2017 | Russell et al. | |
| 2017/0204675 | A1 | 7/2017 | Yu et al. | |
| 2018/0313163 | A1 | 11/2018 | Borge | |
| 2018/0334858 | A1 | 11/2018 | Can | |
| 2019/0055789 | A1 | 2/2019 | Azar et al. | |

* cited by examiner

METHODS OF FORMING CUTTING ELEMENTS

CROSS-REFERENCE TO RELATED APPLICATIONS

This application is a divisional of U.S. patent application Ser. No. 15/977,205, filed May 11, 2018, now U.S. Pat. No. 10,577,869, issued Mar. 3, 2020 which application claims the benefit under 35 U.S.C. § 119(e) of U.S. Provisional Patent Application Ser. No. 62/507,567, filed May 17, 2017, the disclosure of each of which is hereby incorporated herein in its entirety by this reference.

TECHNICAL FIELD

Embodiments of the disclosure relate to cutting elements including internal fluid flow pathways, to methods of forming the cutting elements, and to earth-boring tools including the cutting elements.

BACKGROUND

Earth-boring tools for forming wellbores in subterranean formations may include cutting elements secured to a body. For example, a fixed-cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bi-center bits, eccentric bits, hybrid bits (e.g., rolling components in combination with fixed cutting elements), reamers, and casing milling tools.

Cutting elements used in earth-boring tools often include a supporting substrate and cutting table wherein the cutting table comprises a volume of superabrasive material, such as a volume of polycrystalline diamond ("PCD") material, on or over the supporting substrate. Surfaces of the cutting table act as cutting surfaces of the cutting element. During a drilling operation, cutting edges at least partially defined by peripheral portions of the cutting surfaces of the cutting elements are pressed into the formation. As the earth-boring tool moves (e.g., rotates) relative to the subterranean formation, the cutting elements drag across surfaces of the subterranean formation and the cutting edges shear away formation material.

During a drilling operation, the cutting elements of an earth-boring tool may be subjected to high temperatures (e.g., due to friction between the cutting table and the subterranean formation being cut), which can result in undesirable thermal damage to the cutting tables of the cutting elements. Such thermal damage can cause one or more of decreased cutting efficiency, separation of the cutting tables from the supporting substrates of the cutting elements, and separation of the cutting elements from the earth-boring tool to which they are secured.

Accordingly, it would be desirable to have cutting elements, earth-boring tools (e.g., rotary drill bits), and methods of forming and using the cutting elements and the earth-boring tools facilitating enhanced cutting efficiency and prolonged operational life during drilling operations as compared to conventional cutting elements, conventional earth-boring tools, and conventional methods of forming and using the conventional cutting elements, and the conventional earth-boring tools.

BRIEF SUMMARY

Embodiments described herein include cutting elements including internal fluid flow pathways, as well as methods of forming the cutting elements, and earth-boring tools including the cutting elements. For example, in accordance with one embodiment described herein, a cutting element comprises a supporting substrate, a cutting table comprising a hard material attached to the supporting substrate, and a fluid flow pathway extending through the supporting substrate and the cutting table. The fluid flow pathway is configured to direct fluid delivered to an outermost boundary of the supporting substrate through internal regions of the supporting substrate and the cutting table.

In additional embodiments, a method of forming a cutting element comprises forming an assembly comprising a supporting substrate, a hard material powder over the supporting substrate, and an acid-dissolvable structure embedded within the supporting substrate and the hard material powder. The supporting substrate, the hard material powder, and the acid-dissolvable structure are subjected to elevated temperatures and elevated pressures to inter-bond discrete hard material particles of the hard material powder and form a cutting table attached to the supporting substrate. The acid-dissolvable structure is removed from the cutting table and the supporting substrate.

In further embodiments, an earth-boring tool comprises a structure having at least one pocket therein, and at least one cutting element secured within the at least one pocket in the structure. The at least one cutting element comprises a supporting substrate, a cutting table comprising a hard material attached to the supporting substrate, and a fluid flow pathway extending through the supporting substrate and the cutting table. The fluid flow pathway is configured to direct fluid delivered to an outermost boundary of the supporting substrate from the structure through internal regions of the supporting substrate and the cutting table.

DETAILED DESCRIPTION

Figure 1:
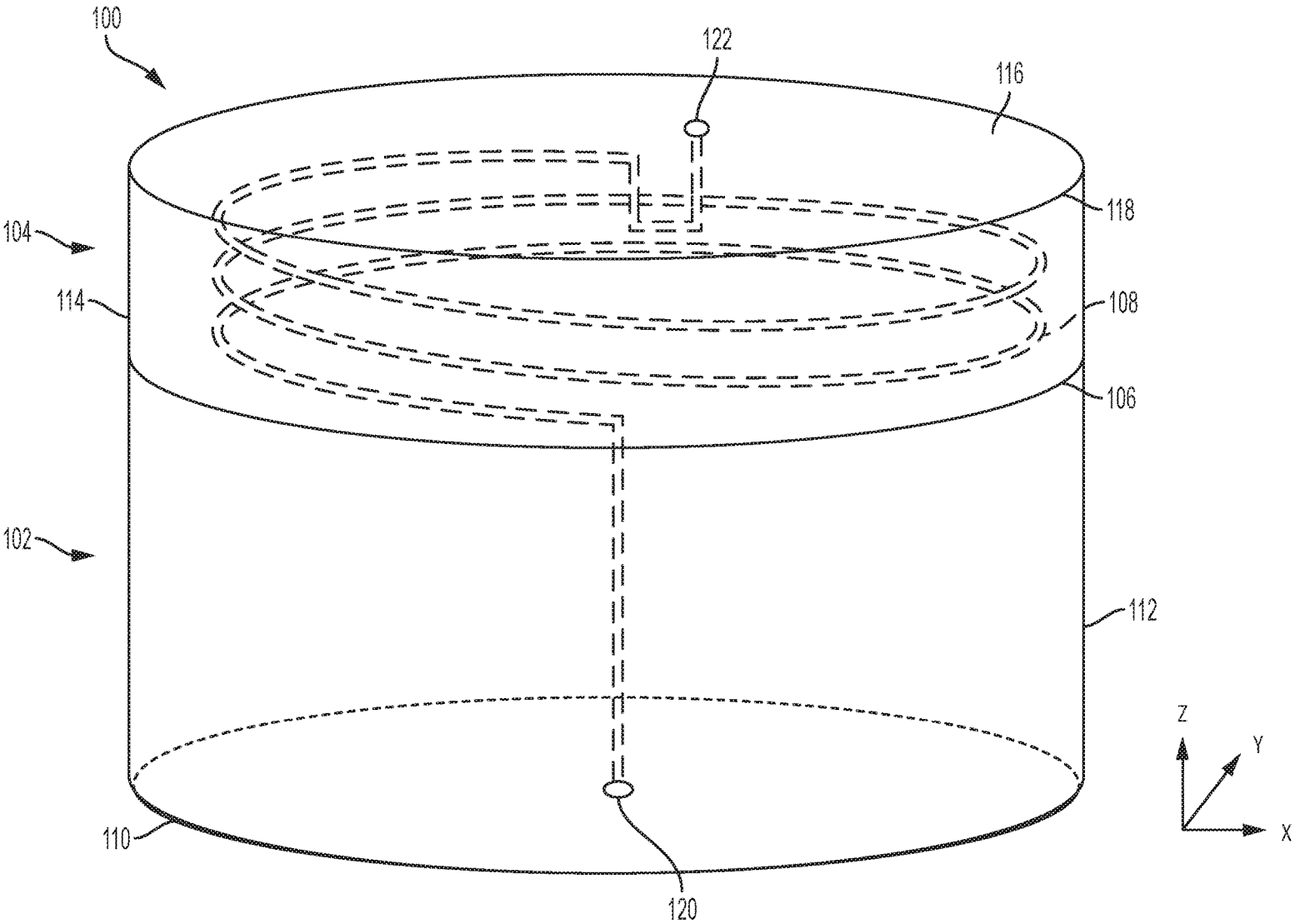
FIGS. 1 through 3 are simplified perspective views of different cutting element configurations, in accordance with embodiments of the disclosure.

Cutting elements for use in earth-boring tools are described, as are earth-boring tools including the cutting elements, and methods of forming and using the cutting elements and the earth-boring tools. In some embodiments, a cutting element includes a supporting substrate, a cutting table comprising a hard material attached to the supporting substrate, and at least one fluid flow pathway extending (e.g., longitudinally extending, laterally extending) through the supporting substrate and the cutting table. The fluid flow pathway may include a tunnel embedded within and traversing each of the supporting substrate and the cutting table from an inlet in an external surface of the supporting substrate. The fluid flow pathway of the cutting element is configured and positioned to receive fluid (e.g., coolant fluid) from at least one fluid flow pathway of an earth-boring tool operatively associated with the cutting element, and to flow the fluid therethrough to cool internal regions of the supporting substrate and the cutting table during use and operation of the earth-boring tool. The configurations of the cutting elements and earth-boring tools described herein may provide enhanced drilling efficiency and improved operational life as compared to the configurations of conventional cutting elements and conventional earth-boring tools.

The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting element or earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal," "vertical," "lateral," and "horizontal" and are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, material distribution, orientation, and arrangement of one or more of at least one structure and at least one apparatus facilitating operation of one or more of the structure and the apparatus in a pre-determined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of hard material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), or cubic boron nitride.

FIG. 1 illustrates a simplified perspective view of cutting element 100, in accordance with an embodiment of the disclosure. The cutting element 100 includes a supporting substrate 102, a cutting table 104 attached (e.g., bonded, adhered) to the supporting substrate 102 at an interface 106, and at least one fluid flow pathway 108 extending (e.g., longitudinally extending, laterally extending) through the supporting substrate 102 and the cutting table 104. While FIG. 1 depicts a particular cutting element configuration, one of ordinary skill in the art will appreciate that different cutting element configurations are known in the art, which may be adapted to be employed in embodiments of the disclosure. Namely, FIG. 1 illustrates a non-limiting example of a cutting element configuration of the disclosure.

The supporting substrate 102 includes at least one lower surface 110 opposite the interface 106 between the supporting substrate 102 and the cutting table 104, and at least one side surface 112 (e.g., sidewall, barrel wall) extending between the lower surface 110 and the interface 106. The supporting substrate 102 may exhibit any desired peripheral (e.g., outermost) geometric configuration (e.g., peripheral shape and peripheral size). The supporting substrate 102 may, for example, exhibit a peripheral shape and a peripheral size at least partially complementary to (e.g., substantially similar to) a peripheral geometric configuration of at least a portion of the cutting table 104 thereon or thereover. The peripheral shape and the peripheral size of the supporting substrate 102 may also be configured to permit the supporting substrate 102 to be received within and/or located upon an earth-boring tool, as described in further detail below. By way of non-limiting example, as shown in FIG. 1, the supporting substrate 102 may exhibit a circular cylinder shape. In additional embodiments, the supporting substrate 102 may exhibit a different peripheral shape (e.g., a conical shape; a frustoconical shape; truncated versions thereof; or an irregular shape, such as a complex shape complementary to both of the cutting table 104 thereon or thereover and a recess or socket in an earth-boring tool to receive and hold the supporting substrate 102). In addition, the interface 106 between the supporting substrate 102 and the cutting table 104 (and, hence, opposing surfaces of the supporting substrate 102 and the cutting table 104) may be substantially planar, or may be non-planar (e.g., curved, angled, jagged, sinusoidal, V-shaped, U-shaped, irregularly shaped, combinations thereof, etc.).

The supporting substrate 102 may be formed of and include a material that is relatively hard and resistant to wear. By way of non-limiting example, the supporting substrate 102 may be formed from and include a ceramic-metal composite material (also referred to as a "cermet" material). In some embodiments, the supporting substrate 102 is formed of and includes a cemented carbide material, such as a cemented tungsten carbide material, in which tungsten carbide particles are cemented together in a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a catalyst material such as cobalt, nickel, iron, or alloys and mixtures thereof. In some embodiments, the supporting substrate 102 is formed of and includes a cobalt-cemented tungsten carbide material.

With continued reference to FIG. 1, the cutting table 104 may be positioned on or over the supporting substrate 102. The cutting table 104 includes at least one side surface 114 (e.g., sidewall, barrel wall), at least one cutting surface 116 (e.g., top surface, upper surface) opposite the interface 106 between the supporting substrate 102 and the cutting table 104, and at least one cutting edge 118 between the side surface 114 and the cutting surface 116. The side surface 114 of the cutting table 104 may be coextensive and continuous with the side surface 112 of the supporting substrate 102. The cutting table 104 may exhibit any desired peripheral geometric configuration (e.g., peripheral shape and peripheral size). By way of non-limiting example, as shown in FIG. 1, the cutting table 104 may exhibit a circular cylinder shape including a substantially consistent (e.g., substantially uniform, substantially non-variable) circular lateral cross-sectional shape throughout a longitudinal thickness thereof. In additional embodiments, the cutting table 104 exhibits a different peripheral geometric configuration. For example, the cutting table 104 may comprise a three-dimensional (3D) structure exhibiting a substantially consistent lateral cross-sectional shape but variable (e.g., non-consistent, such as increasing and/or decreasing) lateral cross-sectional dimensions throughout the longitudinal thickness thereof, may comprise a 3D structure exhibiting a different substantially consistent lateral cross-sectional shape (e.g., an ovular shape, an elliptical shape, a semicircular shape, a tombstone shape, a crescent shape, a triangular shape, a rectangular shape, a kite shape, an irregular shape, etc.) and substantially consistent lateral cross-sectional dimensions throughout the longitudinal thickness thereof, or may comprise a 3D structure exhibiting a variable lateral cross-sectional shape and variable lateral cross-sectional dimensions throughout the longitudinal thickness thereof.

The cutting table 104 may be formed of and include at least one hard material, such as at least one polycrystalline material (e.g., a PCD material). The hard material may, for example, be formed from diamond particles (also known as "diamond grit") mutually bonded in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, a cobalt-titanium alloy, a cobalt-nickel-vanadium alloy, an iron-nickel alloy, an iron-nickel-chromium alloy, an iron-manganese alloy, an iron-silicon alloy, a nickel-chromium alloy, and a nickel-manganese alloy; combinations thereof; etc.). The diamond particles may comprise one or more of natural diamond and synthetic diamond, and may include a monomodal distribution or a multimodal distribution of particle sizes. In additional embodiments, the hard material is formed of and includes a different polycrystalline material, such as one or more of polycrystalline cubic boron nitride, a carbon nitride, and another hard material known in the art. Interstitial spaces between inter-bonded particles (e.g., inter-bonded diamond particles) of the hard material may be at least partially filled with catalyst material (e.g., Co, Fe, Ni, another element from Group VIIIA of the Periodic Table of the Elements, alloys thereof, combinations thereof, etc.), and/or may be substantially free of catalyst material.

As shown in FIG. 1, the fluid flow pathway 108 is located (e.g., embedded) within and at least partially (e.g., substantially) extends through each of the supporting substrate 102 and the cutting table 104. The fluid flow pathway 108 is configured to facilitate internal cooling of the supporting substrate 102 and the cutting table 104. The fluid flow pathway 108 is configured to receive fluid (e.g., coolant fluid) directed toward one or more surfaces (e.g., the lower surface 110, the side surface 112) of the supporting substrate 102, and to flow the fluid therethrough to cool internal regions of the supporting substrate 102 and the cutting table 104 adjacent thereto during use and operation of the cutting element 100.

The fluid flow pathway 108 of the cutting element 100 may exhibit at least one inlet 120, and at least one outlet 122 in fluid communication with the inlet 120. The inlet 120 and the outlet 122 may be disposed (e.g., located, positioned) at outermost boundaries of the cutting element 100. The inlet 120 may be formed in at least one external surface (e.g., the lower surface 110, the side surface 112) of the supporting substrate 102, and may receive fluid (e.g., coolant fluid) into the cutting element 100. The outlet 122 may be formed in at least one external surface (e.g., the cutting surface 116, the side surface 114) of the cutting table 104, and may direct the fluid from the cutting element 100. By way of non-limiting example, as shown in FIG. 1, the inlet 120 may be formed in the lower surface 110 of the supporting substrate 102, and the outlet 122 may be formed in the cutting surface 116 of the cutting table 104. In additional embodiments, the inlet 120 may be formed in the side surface 112 of the supporting substrate 102, and/or the outlet 122 may be formed in the side surface 114 of the cutting table 104.

The position of the inlet 120 of the fluid flow pathway 108 along an external surface (e.g., the lower surface 110, and/or the side surface 112) of the supporting substrate 102 may be selected at least partially based on a configuration of a pocket in an earth-boring tool to receive the cutting element 100, as described in further detail below. For example, the inlet 120 may be positioned at a location along an external surface of the supporting substrate 102 substantially aligned with a fluid flow pathway of the earth-boring tool exposed within the pocket. As shown in FIG. 1, in some embodiments, the inlet 120 of the fluid flow pathway 108 is located in the lower surface 110 of the supporting substrate 102, and is substantially centered about a central longitudinal axis of the cutting element 100. In additional embodiments, the inlet 120 of the fluid flow pathway 108 is located in the lower surface 110 of the supporting substrate 102, but is laterally offset from the central longitudinal axis of the cutting element 100 in one or more directions (e.g., the X-direction and/or the Y-direction). In further embodiments, the inlet 120 of the fluid flow pathway 108 is located in the side surface 112 of the supporting substrate 102 at a predetermined location along the height (in the Z-direction) of the supporting substrate 102.

The position of the outlet 122 of the fluid flow pathway 108 along an external surface (e.g., the cutting surface 116, and/or the side surface 114) of the cutting table 104 may be selected at least partially based on the geometric configuration of the fluid flow pathway 108 within the supporting substrate 102 and the cutting table 104, and on a predetermined position and orientation of the cutting element 100 along an earth-boring tool to receive the cutting element 100, as described in further detail below. As shown in FIG. 1, in some embodiments, the outlet 122 is located in the cutting surface 116 of the cutting table 104, and is laterally offset from a central longitudinal axis of the cutting element 100 in one or more directions (e.g., the X-direction and/or the Y-direction). In additional embodiments, the outlet 122 is located in the cutting surface 116 of the cutting table 104, but is substantially centered about a central longitudinal axis of the cutting element 100. In further embodiments, the outlet 122 is located in the side surface 114 of the cutting table 104 at a predetermined location along the height (in the Z-direction) of the cutting table 104.

The fluid flow pathway 108 may include a single (e.g., only one) inlet 120 and a single outlet 122, may include a single inlet 120 and multiple (e.g., more than one) outlets 122, may include multiple inlets 120 and a single outlet 122, or may include multiple inlets 120 and multiple outlets 122. As shown in FIG. 1, in some embodiments, the fluid flow pathway 108 includes one (1) inlet 120 and one (1) outlets 122. In additional embodiments, the fluid flow pathway 108 may include a different number of inlets 120 and/or a different number of outlet 122, such greater than or equal to two (2) inlets 120 and/or greater than or equal to two (2) outlets 122. Multiple inlets 120 and/or multiple outlets 122 may, for example, permit increased flow of fluid through the fluid flow pathway 108 during use and operation of the cutting element 100. Each of the inlet(s) 120 and each of the outlet(s) 122 may exhibit substantially the same geometric configuration (e.g., substantially the same shape, and substantially the same dimensions) as one another, or one or more the inlet(s) 120 and/or one or more the outlet(s) 122 may exhibit a different geometric configuration (e.g., a different shape, and/or one or more different dimensions) than one or more other of the inlet(s) 120 and/or one or more other of the outlet(s) 122.

Portions of the fluid flow pathway 108 intervening between the inlet 120 and the outlet 122 may be substantially completely surrounded (e.g., covered, enveloped, encased) by one or more materials of the cutting element 100 (e.g., the material of the supporting substrate 102, and the hard material of the cutting table 104). The fluid flow pathway 108 may comprise a tunnel (e.g., through opening, through via) embedded within and traversing through the materials of the cutting element 100. Put another way, portions of the fluid flow pathway 108 intervening between the inlet 120 and the outlet 122 may be positioned inward (e.g., longitudinally inward, laterally inward) of the external surfaces (e.g., the lower surface 110 of the supporting substrate 102, the side surface 112 of the supporting substrate 102, the cutting surface 116 of the cutting table 104, the side surface 114 of the cutting table 104) of the cutting element 100.

The fluid flow pathway 108 may extend in an at least partially non-linear path through the materials of the cutting element 100. For example, as shown in FIG. 1, the fluid flow pathway 108 may extend in a partially non-linear path including a linear section longitudinally extending (in the Z-direction) through the supporting substrate 102, and a non-linear section laterally and longitudinally extending (in the X-, Y-, and Z-directions) through the cutting table 104. The linear section of the fluid flow pathway 108 may longitudinally extend substantially completely through the supporting substrate 102, and may be integral and continuous with the non-linear section of the fluid flow pathway 108. The non-linear section of the fluid flow pathway 108 coils (e.g., wind, spiral) upwardly through the cutting table 104 from the linear section to the outlet 122. In some embodiments, one or more portions of the non-linear section of the fluid flow pathway 108 laterally extend substantially parallel to the circumference (e.g., outermost lateral boundaries) of the cutting table 104, such that a curvature of the one or more portions of the non-linear section of the fluid flow pathway 108 is substantially the same as the circumferential curvature of the cutting table 104. In additional embodiments, one or more portions of the non-linear section of the fluid flow pathway 108 laterally extend non-parallel to the circumference of the cutting table 104, such that a curvature of the one or more portions of the non-linear section of the fluid flow pathway 108 is different than the circumferential curvature of the cutting table 104. In further embodiments, the fluid flow pathway 108 may extend in a different path (e.g., a different at least partially non-linear path, a substantially linear path) than that shown in FIG. 1. For example, at least a portion of the fluid flow pathway 108 extending through the supporting substrate 102 may be non-linear (e.g., arcuate, angled, jagged, sinusoidal, V-shaped, U-shaped, irregularly shaped combinations thereof), and/or at least a portion of fluid flow pathway 108 extending through the cutting table 104 may be substantially linear or may have a different non-linear configuration (e.g., a different non-linear shape laterally and longitudinally extending in the X-, Y-, and Z-directions; a different non-linear shape laterally extending in the X-direction or the Y-direction, and longitudinally extending in the Z-direction) than that shown in FIG. 1. Non-limiting examples of such different paths are described in further detail below.

The fluid flow pathway 108 may exhibit a cross-sectional geometric configuration (e.g., cross-sectional shape and cross-sectional dimensions) permitting fluid to enter into and cool the cutting element 100 during the use and operation of the cutting element 100. The fluid flow pathway 108 may, for example, exhibit one or more of a circular cross-sectional shape, a rectangular cross-sectional shape, an annular cross-sectional shape, a square cross-sectional shapes, a trapezoidal cross-sectional shape, a semicircular cross-sectional shape, a crescent cross-sectional shape, an ovular cross-sectional shape, ellipsoidal cross-sectional shape, a triangular cross-sectional shape, truncated versions thereof, and an irregular cross-sectional shape. In some embodiments, the fluid flow pathway 108 exhibits a substantially circular cross-sectional shape. In addition, the fluid flow pathway 108 may, for example, exhibit one or more cross-sectional dimensions (e.g., widths, heights) greater than or equal to about 0.2 mm, such as within a range of from about 0.2 mm to about 3 mm, within a range of from about 0.2 mm to about 2 mm, or within a range of from about 0.2 mm to about 1 mm. In some embodiments, the fluid flow pathway 108 exhibits a diameter of about 0.75 mm. All of the different portions of the fluid flow pathway 108 may exhibit substantially the same cross-sectional geometric configuration (e.g., substantially the same cross-sectional shape and substantially the same cross-sectional dimensions), or at least one portion of the fluid flow pathway 108 may exhibit a different geometric cross-sectional configuration (e.g., a different cross-sectional shape and/or one or more different cross-sectional dimensions) than at least one other section of the fluid flow pathway 108. In some embodiments, each of the different portions of fluid flow pathway 108 exhibits substantially the same cross-sectional geometric configuration.

The cutting element 100 may include any quantity and any distribution of fluid flow pathway(s) 108 facilitating a desired and predetermined amount of cooling of the supporting substrate 102 and the cutting table 104 during use and operation of cutting element 100, while also facilitating desired and predetermined structural integrity of the cutting element 100 during the use and operation thereof. The fluid flow pathway(s) 108 may occupy less than or equal to about fifty (50) percent (e.g., less than or equal to about forty (40) percent, less than or equal to about thirty (30) percent, less than or equal to about twenty (20) percent, less than or equal to about ten (10) percent, or less than or equal to about five (5) percent) of the volume of the cutting table 104. The quantity and the distribution of the fluid flow pathway(s) 108 may at least partially depend on the configurations (e.g., material compositions, material distributions, shapes, sizes, orientations, arrangements, etc.) of the supporting substrate 102, the cutting table 104, and the fluid flow pathway(s) 108. In some embodiments, the cutting element 100 includes a single (e.g., only one) fluid flow pathway 108. In additional embodiments, the cutting element 100 includes greater than or equal to two (2) fluid flow pathways 108. If the cutting element 100 includes multiple fluid flow pathways 108, the fluid flow pathways 108 may be discrete (e.g., separate) from and discontinuous with one another. In addition, if the cutting element 100 includes multiple fluid flow pathways 108, the fluid flow pathways 108 may be symmetrically distributed within the materials (e.g., the material of the supporting substrate 102, the hard material of the cutting table 104) of the cutting element 100, or may be asymmetrically distributed within the materials of the cutting element 100.

The cutting element 100 may be formed by providing an assembly including the supporting substrate 102, a hard material powder (e.g., diamond powder) on or over the supporting substrate 102, and at least one dissolvable (e.g., acid-dissolvable) structure (e.g., at least one acid-dissolvable wire, such as at least one acid-dissolvable wire comprising greater than or equal to about 10 weight percent rhenium (Re)) embedded within the supporting substrate 102 and the hard material powder into a container; subjecting the supporting substrate 102, the hard material powder, and the dissolvable structure to high temperature/high pressure (HTHP) processing to form the hard material, and then removing (e.g., dissolving, leaching) the dissolvable structure to form the cutting element 100 including the fluid flow pathway 108 therein. The HTHP process may include subjecting the hard material powder, the dissolvable structure, and the supporting substrate 102 to elevated temperatures and pressures in a heated press for a sufficient time to inter-bond discrete hard material particles of the hard material powder. Although the exact operating parameters of HTHP processes will vary depending on the particular compositions and quantities of the various materials being sintered, pressures in the heated press may be greater than or equal to about 5.0 gigapascals (GPa) (e.g., greater than or equal to about 6.5 GPa, such as greater than or equal to about 6.7 GPa) and temperatures may be greater than or equal to about 1,400° C. Furthermore, the materials and structures being sintered may be held at such temperatures and pressures for a time period between about 30 seconds and about 20 minutes. In addition, the dissolvable structure (e.g., Rhenium-containing structure) may, for example, be removed by exposing the material of the supporting substrate 102, the hard material of the cutting table 104, and the dissolvable structure to a leaching agent for a sufficient period of time to remove the dissolvable structure. Suitable leaching agents are known in the art and described more fully in, for example, U.S. Pat. No. 5,127,923 to Bunting et al. (issued Jul. 7, 1992); and U.S. Pat. No. 4,224,380 to Bovenkerk et al. (issued Sep. 23, 1980); the disclosure of each of which is incorporated herein in its entirety by this reference. By way of non-limiting example, at least one of aqua *regia* (i.e., a mixture of concentrated nitric acid and concentrated hydrochloric acid), boiling hydrochloric acid, and boiling hydrofluoric acid may be employed as a leaching agent. In some embodiments, the leaching agent may comprise hydrochloric acid at a temperature greater than or equal to about 110° C. The leaching agent may be provided in contact with the material of the supporting substrate 102, the hard material of the cutting table 104, and the dissolvable structure for a period of from about 30 minutes to about 60 hours.

Figure 2:
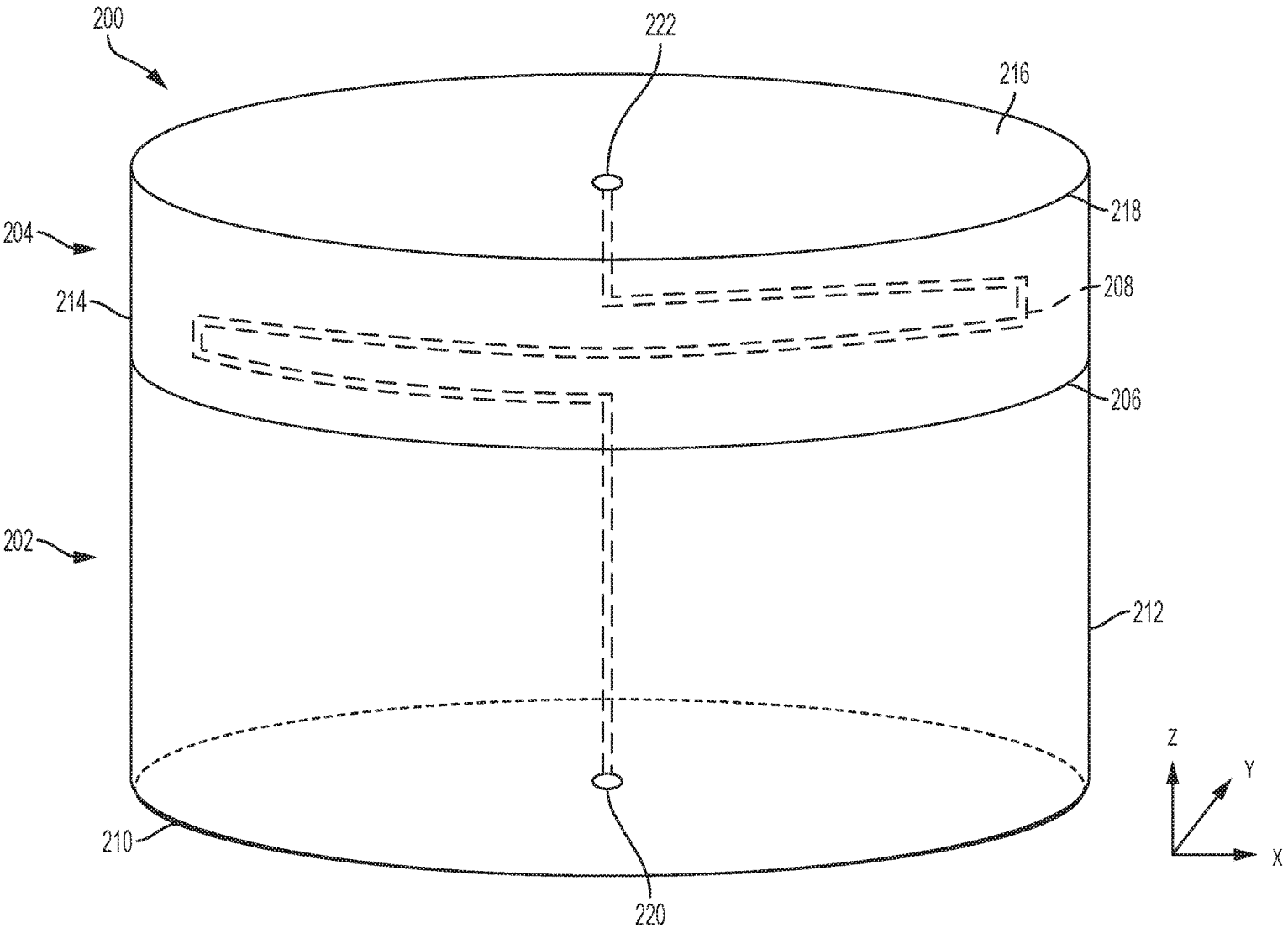
Figure 3:
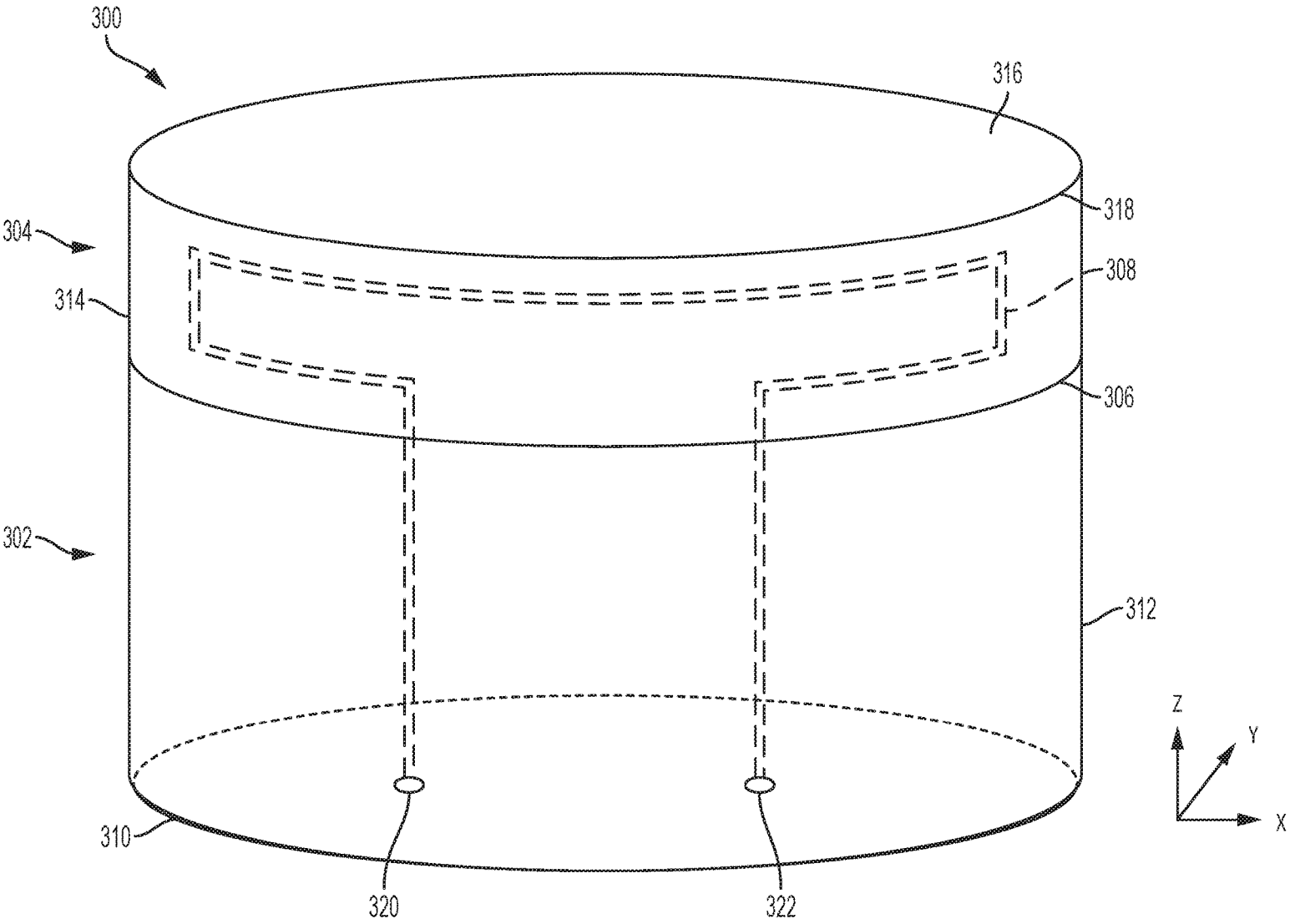

As previously discussed, while FIG. 1 depicts a particular configuration of the cutting element 100, including a particular configuration of the fluid flow pathway 108 thereof, different configurations may be employed. By way of non-limiting example, in accordance with additional embodiments of the disclosure, FIGS. 2 and 3 show simplified perspective views of cutting elements exhibiting different configurations than that of the cutting element 100 shown in FIG. 1. Throughout the remaining description and the accompanying figures, functionally similar features are referred to with similar reference numerals incremented by 100. To avoid repetition, not all features shown in the remaining figures are described in detail herein. Rather, unless described otherwise below, a feature designated by a reference numeral that is a 100 increment of the reference numeral of a previously-described feature (whether the previously-described feature is first described before the present paragraph, or is first described after the present paragraph) will be understood to be substantially similar to the previously-described feature.

FIG. 2 illustrates a simplified perspective view of a cutting element 200, in accordance with another embodiment of the disclosure. As shown in FIG. 2, the cutting element 200 includes a supporting substrate 202, a cutting table 204 attached to the supporting substrate 202 at an interface 206, and at least one fluid flow pathway 208 embedded within the supporting substrate 202 and the cutting table 204. The fluid flow pathway 208 extends in an at least partially non-linear path through the supporting substrate 202 and the cutting table 204, and includes an inlet 220 in a lower surface 210 of the supporting substrate 202 and an outlet 222 in a cutting surface 216 of the cutting table 204. As shown in FIG. 2, the at least partially non-linear path of the fluid flow pathway 208 may include a linear section longitudinally extending through the supporting substrate 202, and a non-linear section integral and continuous with the linear section and longitudinally and laterally extending through the cutting table 204. The non-linear section of the fluid flow pathway 208 may extend along a single (e.g., only one) plane within the cutting element 200. For example, the non-linear section of the fluid flow pathway 208 may extend (e.g., laterally extend, longitudinally extend) along a single XZ plane (e.g., a single plane extending in the X-direction and the Z-direction) intersecting a central longitudinal axis of the cutting element 200. In additional embodiments, the non-linear section of the fluid flow pathway 208 may extend along a different, single plane (e.g., an YZ plane; a XYZ plane; a different XZ plane, such as an XZ plane laterally offset from the central longitudinal axis of the cutting element 200) within the cutting element 200. The cutting element 200, including the fluid flow pathway 208 thereof, may be formed using a process substantially similar to that previously described with respect to the formation of the cutting element 100 (FIG. 1).

FIG. 3 illustrates a simplified perspective view of a cutting element 300, in accordance with another embodiment of the disclosure. As shown in FIG. 3, the cutting element 300 includes a supporting substrate 302, a cutting table 304 attached to the supporting substrate 302 at an interface 306, and at least one fluid flow pathway 308 embedded within the supporting substrate 302 and the cutting table 304. The fluid flow pathway 308 extends in an at least partially non-linear path through the supporting substrate 302 and the cutting table 304, and includes an inlet 320 in a lower surface 310 of the supporting substrate 302, and an outlet 322 in the lower surface 310 of the cutting table 304. As shown in FIG. 3, the at least partially non-linear path of the fluid flow pathway 308 may include at least two (2) linear sections longitudinally extending through the supporting substrate 302 from the inlet 320 and the outlet 322, and at least one (1) non-linear section integral and continuous with the linear sections and longitudinally and laterally extending through the cutting table 304. The different sections (e.g., the linear sections and the non-linear section) of the fluid flow pathway 308 form a loop within the materials of the cutting element 300. As described in further detail below, the looped configuration of the fluid flow pathway 308 may permit fluid (e.g., coolant fluid) delivered into the fluid flow pathway 308 from an earth-boring tool operatively associated with the cutting element 300 to be directed (e.g., recycled) back into the earth-boring tool following desired and predetermined cooling of the cutting element 300. In additional embodiments, the fluid flow pathway 308 may exhibit a different looped configuration than that depicted in FIG. 3. For example, one or more of the inlet 320 and the outlet 322 may be located along a side surface 312 of the supporting substrate 302, and/or the fluid flow pathway 308 may exhibit a different at least partially non-linear path through the supporting substrate 302 and the cutting table 304. The cutting element 300, including the fluid flow pathway 308 thereof, may be formed using a process substantially similar to that previously described with respect to the formation of the cutting element 100 (FIG. 1).

Figure 4:
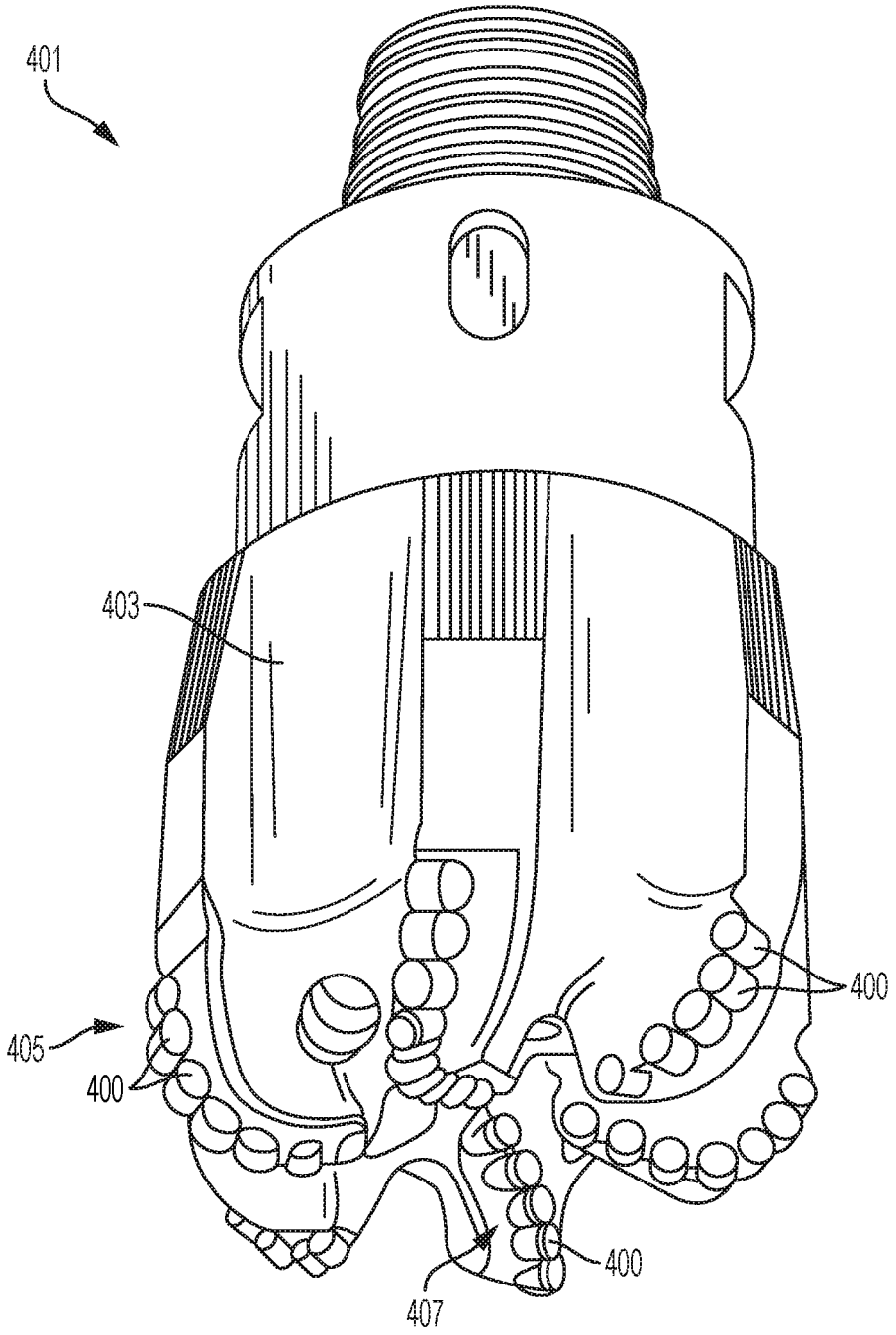
FIG. 4 is a simplified perspective view of a fixed-cutter earth-boring rotary drill bit configuration, in accordance with embodiments of the disclosure.

Cutting elements (e.g., the cutting elements 100, 200, 300) according to embodiments of the disclosure may be included in earth-boring tools of the disclosure. As a non-limiting example, FIG. 4 illustrates a rotary drill bit 401 (e.g., a fixed-cutter rotary drill bit) including cutting elements 400 secured thereto. The cutting elements 400 may be secured within pockets 407 in one or more blades 405 of a bit body 403 of the rotary drill bit 401. As described in further detail below, the cutting elements 400 may be secured within the pockets 407 such that fluid flow pathways (e.g., the fluid flow pathways 108, 208, 308) of the cutting elements 400 are in fluid communication with fluid flow pathways of the bit body 403. The cutting elements 400 may be substantially similar to one or more of the cutting elements 100, 200, 300 previously described herein. Each of the cutting elements 400 may be substantially the same as each other of the cutting elements 400, or at least one of the cutting elements 400 may be different than at least one other of the cutting elements 400.

The cutting elements 400 may be secured within the pockets 407 in the bit body 403 of the rotary drill bit 401 through various means. By way of non-limiting example, in accordance with embodiments of the disclosure, FIGS. 5 through 11 show simplified partial cross-sectional views of different configurations for securing one or more of the cutting elements 400 within one or more of the pockets 407 in the bit body 403 of the rotary drill bit 401. While FIGS. 5 through 11 depict particular configurations for securing a cutting element (e.g., the cutting elements 100, 200, 300) of the disclosure to an earth-boring tool (e.g., the rotary drill bit 401) of the disclosure, one of ordinary skill in the art will appreciate that different configurations for securing a cutting element to an earth-boring tool are known in the art that may be adapted to be employed in embodiments of the disclosure. FIGS. 5 through 11 illustrate non-limiting examples of configurations for securing a cutting element of the disclosure to an earth-boring tool (e.g., the rotary drill bit 401) of the disclosure. The configurations described below with reference to FIGS. 5 through 11 may be employed in conjunction with the configurations of the cutting elements 100, 200, 300 previously described herein with reference to FIGS. 1 through 3.

Figure 5:
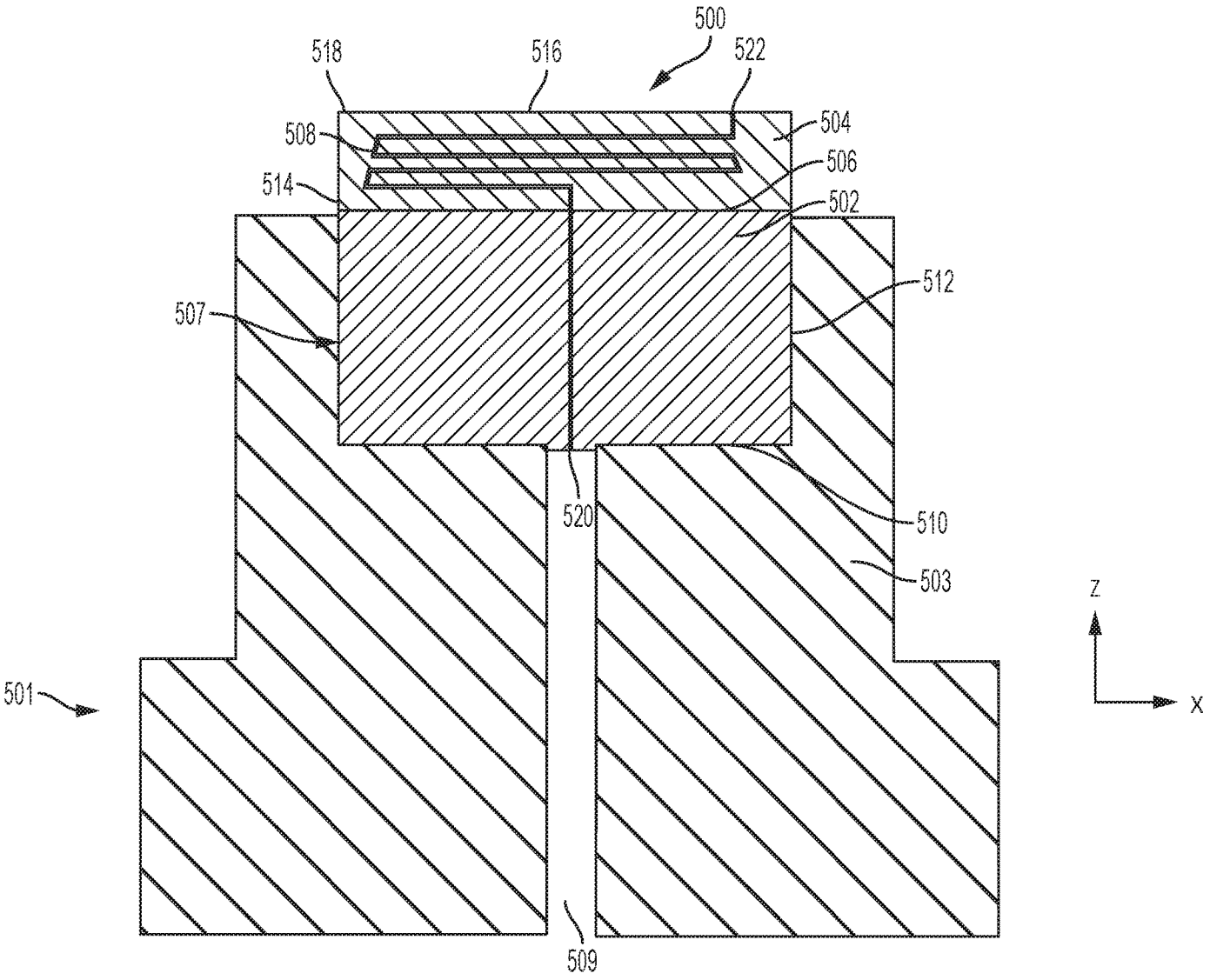
FIGS. 5 through 11 are simplified partial cross-sectional views of different configurations for securing a cutting element of the disclosure to an earth-boring tool of the disclosure.

FIG. 5 illustrates a simplified partial cross-sectional view of a configuration for securing a cutting element of the disclosure to an earth-boring tool of the disclosure. As shown in FIG. 5, a cutting element 500 including a supporting substrate 502, a cutting table 504 attached to the supporting substrate 502 at an interface 506, and at least one fluid flow pathway 508 extending through the supporting substrate 502 and the cutting table 504 may be attached (e.g., joined, adhered) to surfaces of a bit body 503 within a pocket 507 in the bit body 503. The cutting element 500 may be attached to the surfaces of the bit body 503 such that the fluid flow pathway 508 of the cutting element 500 is in fluid communication with a fluid flow pathway 509 of the bit body 503 exposed within the pocket 507. An inlet 520 of the fluid flow pathway 508 of the cutting element 500 may be at least partially (e.g., substantially) aligned with an outlet of the fluid flow pathway 509 of the bit body 503. For example, a portion (e.g., at least a portion of the supporting substrate 502) of the cutting element 500 may be brazed to the bit body 503 within the pocket 507 in a manner permitting the fluid flow pathway 508 of the cutting element 500 and the fluid flow pathway 509 of the bit body 503 to remain unobstructed by braze material. The brazing process may, for example, be controlled such that the braze material is at least disposed between and joins (e.g., adheres) the side surface 512 of the supporting substrate 502 and a side surface of the bit body 503 defining the pocket 507, but is not disposed over the inlet 520 of the fluid flow pathway 508 of the cutting element 500. A portion of the braze material may, optionally, be disposed between and join the lower surface 510 of the supporting substrate 502 and an upper surface of the bit body 503 defining the pocket 507, so long as the fluid flow pathway 508 of the cutting element 500 and the fluid flow pathway 509 of the bit body 503 remain unobstructed by the braze material.

Figure 6:
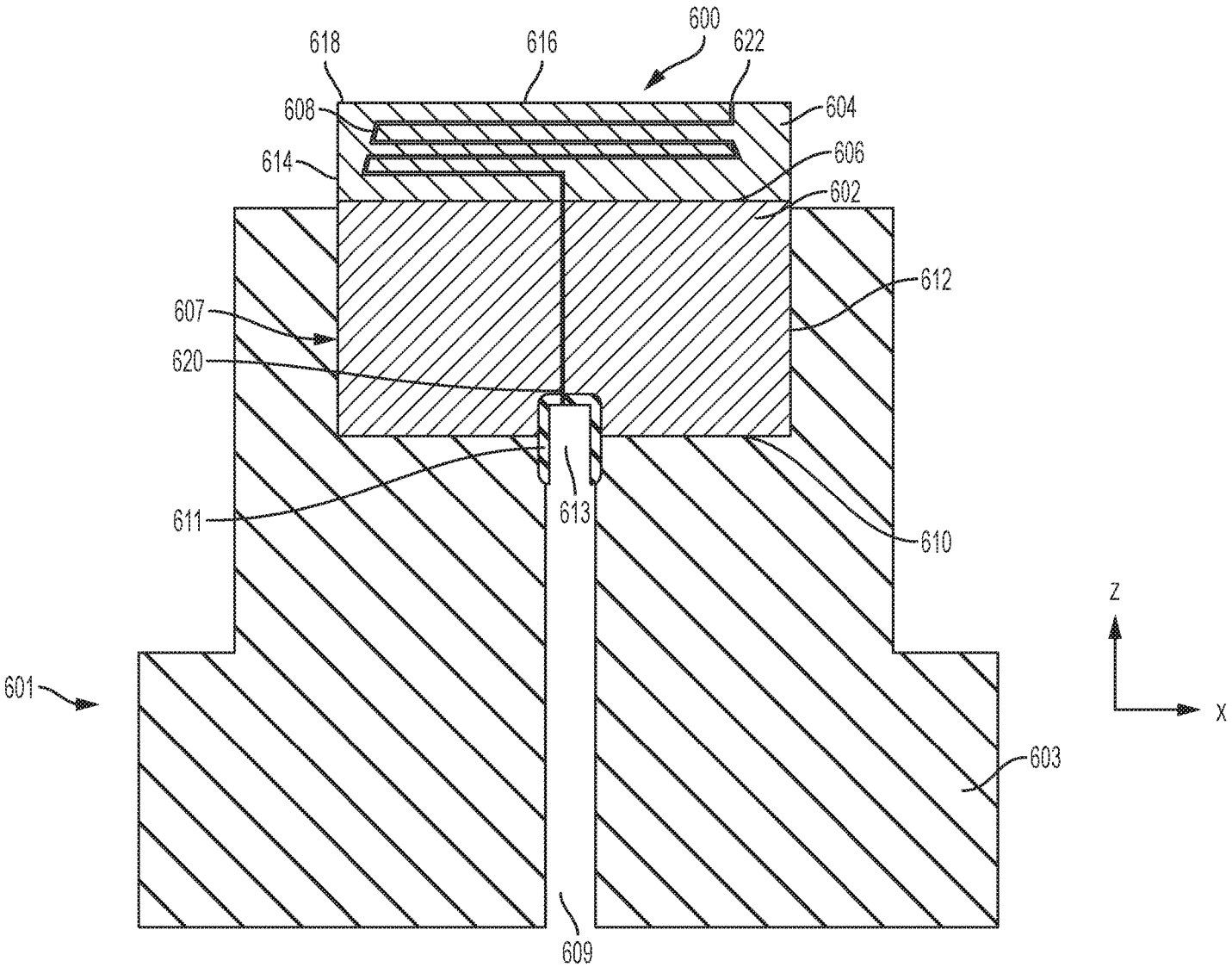

FIG. 6 illustrates a simplified partial cross-sectional view of another configuration for securing a cutting element of the disclosure to an earth-boring tool of the disclosure. As shown in FIG. 6, a cutting element 600 including a supporting substrate 602, a cutting table 604 attached to the supporting substrate 602 at an interface 606, and at least one fluid flow pathway 608 extending through the supporting substrate 602 and the cutting table 604 may be attached to surfaces of a bit body 603 within a pocket 607 in a bit body 603. In addition, a retention structure 611 including at least one fluid flow pathway 613 extending completely therethrough may be disposed between the fluid flow pathway 608 of the cutting element 600 and a fluid flow pathway 609 of the bit body 603. The retention structure 611 may, for example, comprise a hollow structure (e.g., a tubular structure, an annular structure) received and held within a recess in the supporting substrate 602 adjacent the fluid flow pathway 608 of the cutting element 600, and also received and held within a recess in the bit body 603 adjacent the fluid flow pathway 609 of the bit body 603. As shown in FIG. 6, the fluid flow pathway 613 of the retention structure 611 is in fluid communication with each of the fluid flow pathway 608 of the cutting element 600 and the fluid flow pathway 609 of the bit body 603. An inlet 620 of the fluid flow pathway 608 of the cutting element 600 may be at least partially (e.g., substantially) aligned with an outlet of the fluid flow pathway 613 of the retention structure 611, and an inlet of the fluid flow pathway 613 of the retention structure 611 may be at least partially (e.g., substantially) aligned with an outlet of the fluid flow pathway 609 of the bit body 603. The retention structure 611 may serve as a barrier to braze material employed to join surfaces (e.g., a side surface 612, a lower surface 610) of the supporting substrate 602 to surfaces of the bit body 603 defining the pocket 607 to prevent the braze material from obstructing the fluid flow pathway 608 of the cutting element 600 and/or the fluid flow pathway 609 of the bit body 603. For example, during a brazing process employed to join the cutting element 600 to the bit body 603 within the pocket 607, braze material may flow between and subsequently join surfaces of the supporting substrate 602 and opposing surfaces of the bit body 603 within the pocket 607, but may be substantially impeded from flowing over and/or into the fluid flow pathway 608 of the cutting element 600 and the fluid flow pathway 609 of the bit body 603 by the retention structure 611. The retention structure 611 may be formed of any material compatible with the material compositions of the cutting element 600 and the bit body 603, and compatible with the process (e.g., brazing process) employed to attach (e.g., braze) the cutting element 600 to the bit body 603. In some embodiments, the retention structure 611 comprises a metal material (e.g., an alloy, elemental metal).

Figure 7:
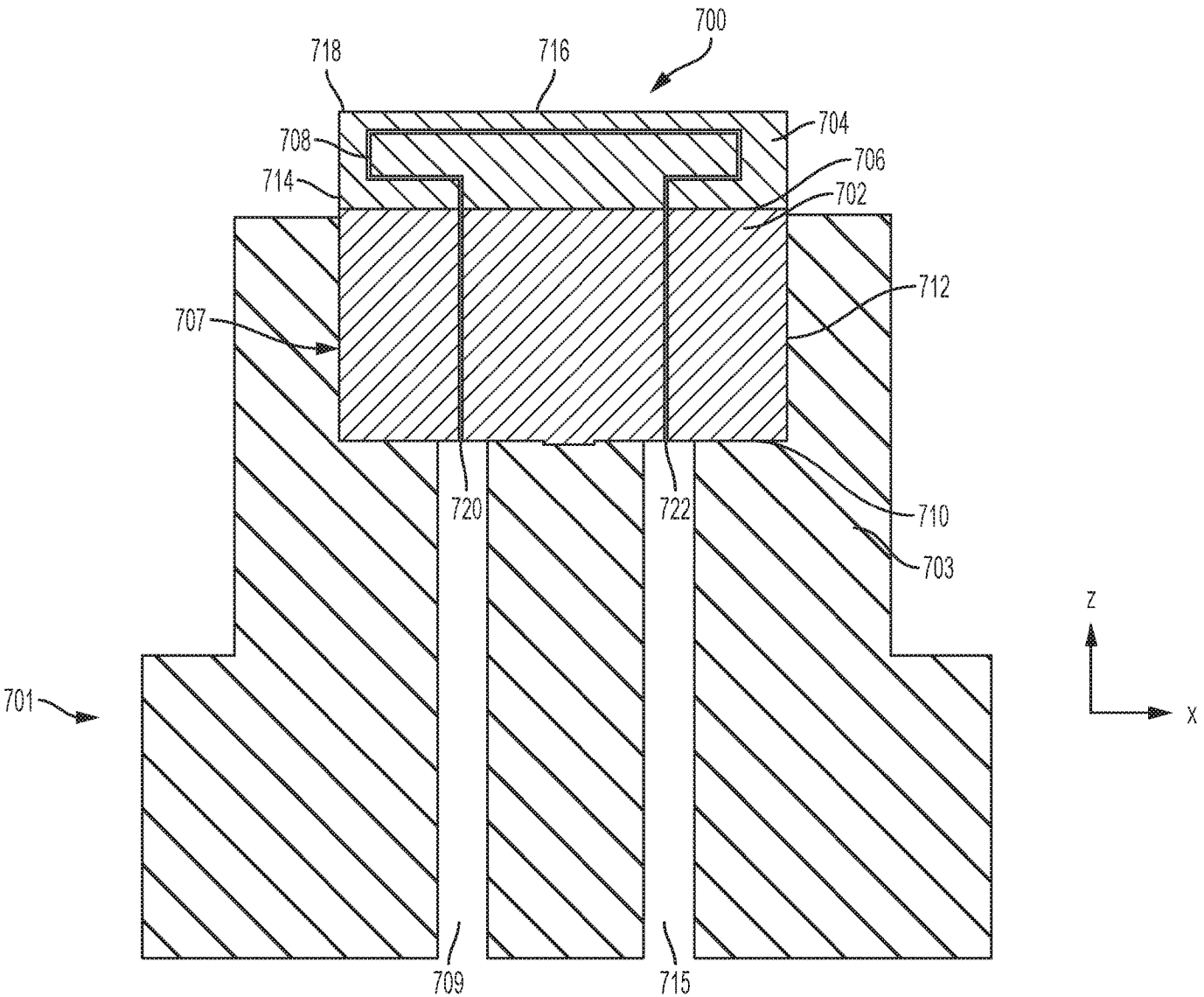

FIG. 7 illustrates a simplified partial cross-sectional view of another configuration for securing a cutting element of the disclosure to an earth-boring tool of the disclosure. As shown in FIG. 7, a cutting element 700 including a supporting substrate 702, a cutting table 704 attached to the supporting substrate 702 at an interface 706, and at least one fluid flow pathway 708 extending through the supporting substrate 702 and the cutting table 704 may be attached to surfaces of a bit body 703 within a pocket 707 in a bit body 703. The fluid flow pathway 708 of the cutting element 700 may exhibit a looped configuration similar to that of the fluid flow pathway 308 of the cutting element 300 previously described with reference to FIG. 3, such that each of an inlet 720 and an outlet 722 of the fluid flow pathway 708 of the cutting element 700 are located along a lower surface 710 of the supporting substrate 702 of the cutting element 700. Accordingly, the fluid flow pathway 708 of the cutting element 700 is in fluid communication with each of a fluid flow pathway 709 of the bit body 703 and an additional fluid flow pathway 715 of the bit body 703. The inlet 720 of the fluid flow pathway 708 of the cutting element 700 may be at least partially (e.g., substantially) aligned with an outlet of the fluid flow pathway 709 of the bit body 703, and the outlet 722 of the fluid flow pathway 708 of the cutting element 700 may be at least partially (e.g., substantially) aligned with an inlet of the additional fluid flow pathway 715 of the bit body 703. The configuration shown in FIG. 7 may permit fluid (e.g., coolant fluid) directed into the fluid flow pathway 708 of the cutting element 700 from the fluid flow pathway 709 of the bit body 703 to be directed into the additional fluid flow pathway 715 of the bit body 703 after flowing through the fluid flow pathway 708 of the cutting element 700, thereby facilitating the recycle and reuse of the fluid. A portion (e.g., at least a portion of the supporting substrate 702) of the cutting element 700 may be brazed to the bit body 703 within the pocket 707 in a manner permitting the inlet 720 and the outlet 722 of the fluid flow pathway 708 of the cutting element 700 to remain unobstructed by braze material. The brazing process may, for example, be controlled such that the braze material is at least disposed between and joins (e.g., adheres) the side surface 712 of the supporting substrate 702 and a side surface of the bit body 703 defining the pocket 707, but is not disposed over the inlet 720 and the outlet 722 of the fluid flow pathway 708 of the cutting element 700. Some of the braze material may, optionally, be disposed between and join the lower surface 710 of the supporting substrate 702 and one or more upper surfaces of the bit body 703 defining the pocket 707, so long as the inlet 720 and the outlet 722 to the fluid flow pathway 708 of the cutting element 700 remain unobstructed by the braze material. In additional embodiments, one or more retention structures similar to the retention structure 611 previously described with reference to FIG. 6 may be employed to prevent the braze material from obstructing (e.g., blocking) the fluid flow pathway 708 of the cutting element 700, the fluid flow pathway 709 of the bit body 703, and/or the additional fluid flow pathway 715 of the bit body 703.

Figure 8:
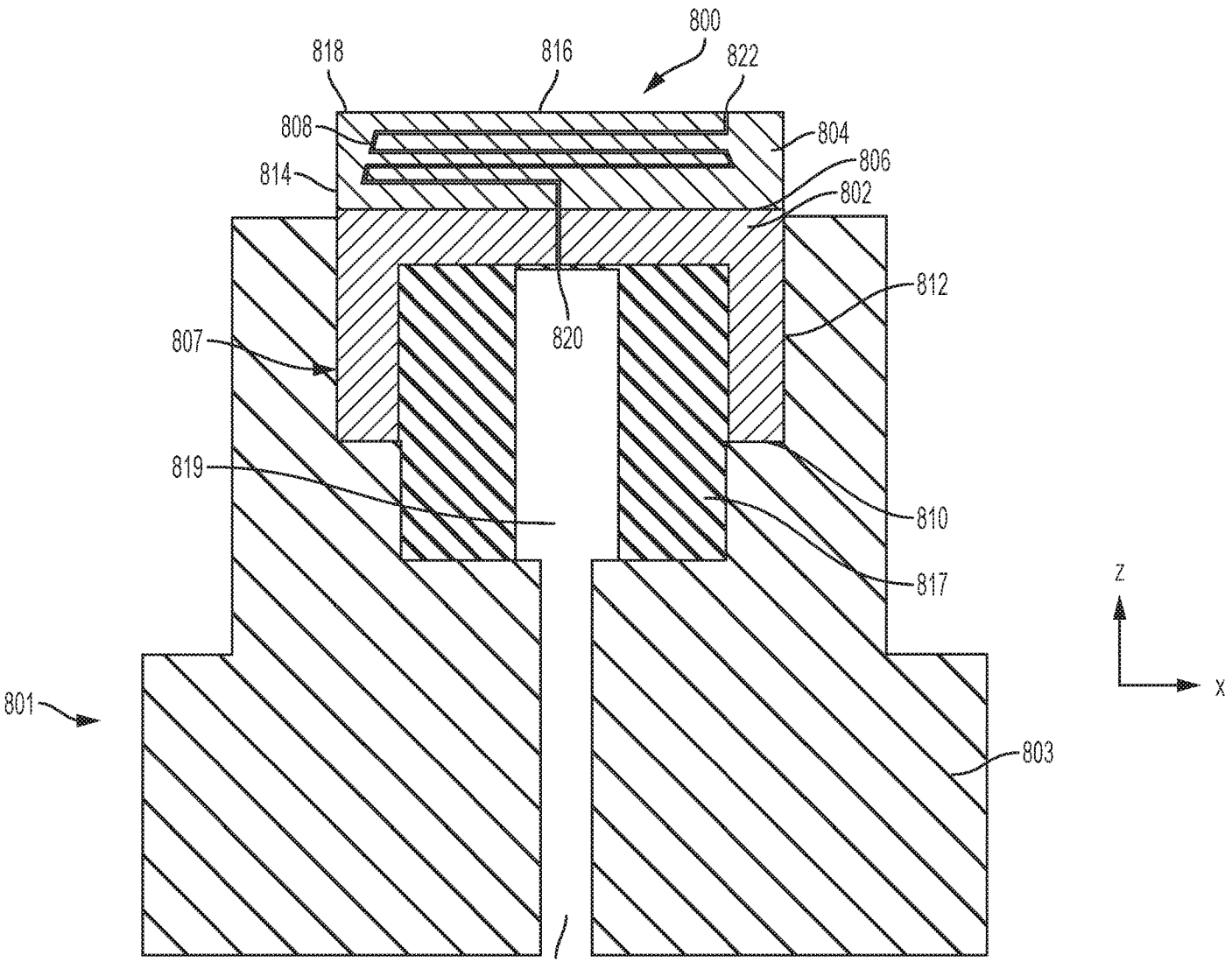

FIG. 8 illustrates a simplified partial cross-sectional view of another configuration for securing a cutting element of the disclosure to an earth-boring tool of the disclosure. As shown in FIG. 8, a cutting element 800 including a supporting substrate 802, a cutting table 804 attached to the supporting substrate 802 at an interface 806, and at least one fluid flow pathway 808 extending through the supporting substrate 802 and the cutting table 804 may be retained (e.g., held) within a pocket 807 in a bit body 803 by way of a shape memory material (SMM) structure 817. The SMM structure 817 may be disposed between the fluid flow pathway 808 of the cutting element 800 and a fluid flow pathway 809 of the bit body 803, and may include at least one fluid flow pathway 819 extending completely therethrough. The SMM structure 817 may, for example, comprise a hollow structure (e.g., a tubular structure, an annular structure) received and held within a recess in the supporting substrate 802 adjacent the fluid flow pathway 808 of the cutting element 800, and also received and held within a recess in the bit body 803 adjacent the fluid flow pathway 809 of the bit body 803. As shown in FIG. 8, the fluid flow pathway 819 of the SMM structure 817 is in fluid communication with each of the fluid flow pathway 808 of the cutting element 800 and the fluid flow pathway 809 of the bit body 803. An inlet 820 of the fluid flow pathway 808 of the cutting element 800 may be at least partially (e.g., substantially) aligned with an outlet of the fluid flow pathway 819 of the SMM structure 817, and an inlet of the fluid flow pathway 819 of the SMM structure 817 may be at least partially (e.g., substantially) aligned with an outlet of the fluid flow pathway 809 of the bit body 803. The SMM structure 817 may retain the cutting element 800 within the pocket 807 in the bit body 803 without the use of a braze material. For example, the SMM structure 817 may retain the cutting element 800 within the pocket 807 in the bit body 803 in a manner substantially similar to that described in one or more of U.S. patent application Ser. No. 15/002,211, filed Jan. 20, 2016, and entitled, "EARTH-BORING TOOLS AND METHODS FOR FORMING EARTH-BORING TOOLS USING SHAPE MEMORY MATERIALS"; U.S. patent application Ser. No. 15/002,189, filed Jan. 20, 2016, and entitled, "NOZZLE ASSEMBLIES INCLUDING SHAPE MEMORY MATERIALS FOR EARTH-BORING TOOLS AND RELATED METHODS"; and U.S. patent application Ser. No. 15/262,893, filed Sep. 12, 2016, and entitled, "METHOD AND APPARATUS FOR SECURING BODIES USING SHAPE MEMORY MATERIALS"; the entire disclosure of each of which is hereby incorporated herein by this reference. In addition, the SMM structure 817 may be formed of and include a shape memory material (e.g., a shape memory alloy, a shape memory polymer) having a material composition substantially similar to that of one or more of the shape memory materials described in one or more of U.S. patent application Ser. Nos. 15/002,211; 15/002,189; and Ser. No. 15/262,893.

Figure 9:
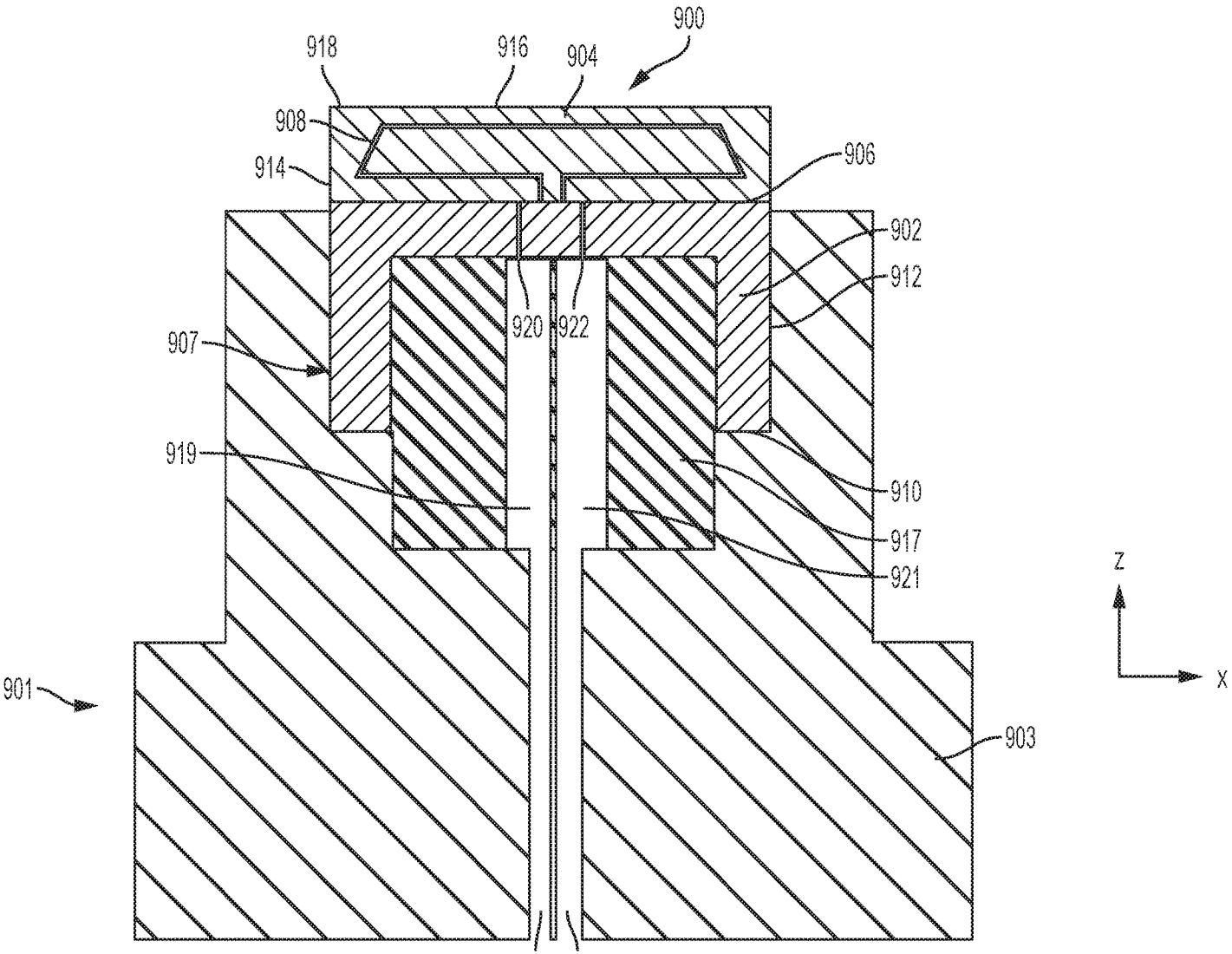

FIG. 9 illustrates a simplified partial cross-sectional view of another configuration for securing a cutting element of the disclosure to an earth-boring tool of the disclosure. As shown in FIG. 9, a cutting element 900 including a supporting substrate 902, a cutting table 904 attached to the supporting substrate 902 at an interface 906, and at least one fluid flow pathway 908 extending through the supporting substrate 902 and the cutting table 904 may be retained (e.g., held) within a pocket 907 in a bit body 903 by way of an SMM structure 917. The fluid flow pathway 908 of the cutting element 900 may exhibit a looped configuration similar to that of the fluid flow pathway 308 of the cutting element 300 previously described with reference to FIG. 3, such that each of an inlet 920 and an outlet 922 of the fluid flow pathway 908 of the cutting element 900 are located along a lower surface 910 of the supporting substrate 902 of the cutting element 900. The fluid flow pathway 908 of the cutting element 900 is in fluid communication with each of a fluid flow pathway 909 of the bit body 903 and an additional fluid flow pathway 915 of the bit body 903. The SMM structure 917 may be disposed between the fluid flow pathway 908 of the cutting element 900 and each of the fluid flow pathway 909 and the additional fluid flow pathway 915 of the bit body 903. The SMM structure 917 includes a fluid flow pathway 919 and an additional fluid flow pathway 921. The fluid flow pathway 919 of the SMM structure 917 extends from and between the fluid flow pathway 909 of the bit body 903 and the inlet 920 of the fluid flow pathway 908 of the cutting element 900. An inlet of the fluid flow pathway 919 of the SMM structure 917 may be at least partially (e.g., substantially) aligned with an outlet of the fluid flow pathway 909 of the bit body 903, and an outlet of fluid flow pathway 919 of the SMM structure 917 may be at least partially (e.g., substantially) aligned with the inlet 920 of the fluid flow pathway 908 of the cutting element 900. The additional fluid flow pathway 921 of the SMM structure 917 extends from and between the outlet 922 of the fluid flow pathway 908 of the cutting element 900 and the additional fluid flow pathway 915 of the bit body 903. An inlet of the additional fluid flow pathway 921 of the SMM structure 917 may be at least partially (e.g., substantially) aligned with the outlet 922 of the fluid flow pathway 908 of the cutting element 900, and an outlet of the additional fluid flow pathway 921 of the SMM structure 917 may be at least partially (e.g., substantially) aligned with an inlet of the additional fluid flow pathway 915 of the bit body 903. The configuration shown in FIG. 9 may permit fluid (e.g., coolant fluid) directed into the fluid flow pathway 908 of the cutting element 900 from the fluid flow pathway 909 of the bit body 903 by way of the fluid flow pathway 919 of the SMM structure 917 to be directed into the additional fluid flow pathway 915 of the bit body 903 by way of the additional fluid flow pathway 921 of the SMM structure 917 after the fluid has been flowed through the fluid flow pathway 908 of the cutting element 900, thereby facilitating the recycle and reuse of the fluid. The SMM structure 917 may retain the cutting element 900 within the pocket 907 in the bit body 903 without the use of a braze material. For example, the SMM structure 917 may retain the cutting element 900 within the pocket 907 in the bit body 903 in a manner substantially similar to that described in one or more of U.S. patent application Ser. Nos. 15/002,211; 15/002,189; and Ser. No. 15/262,893. In addition, the SMM structure 917 may be formed of and include a shape memory material (e.g., a shape memory alloy, a shape memory polymer) having a material composition substantially similar to that of one or more of the shape memory materials described in one or more of U.S. patent application Ser. Nos. 15/002,211; 15/002,189; and Ser. No. 15/262,893.

Figure 10:
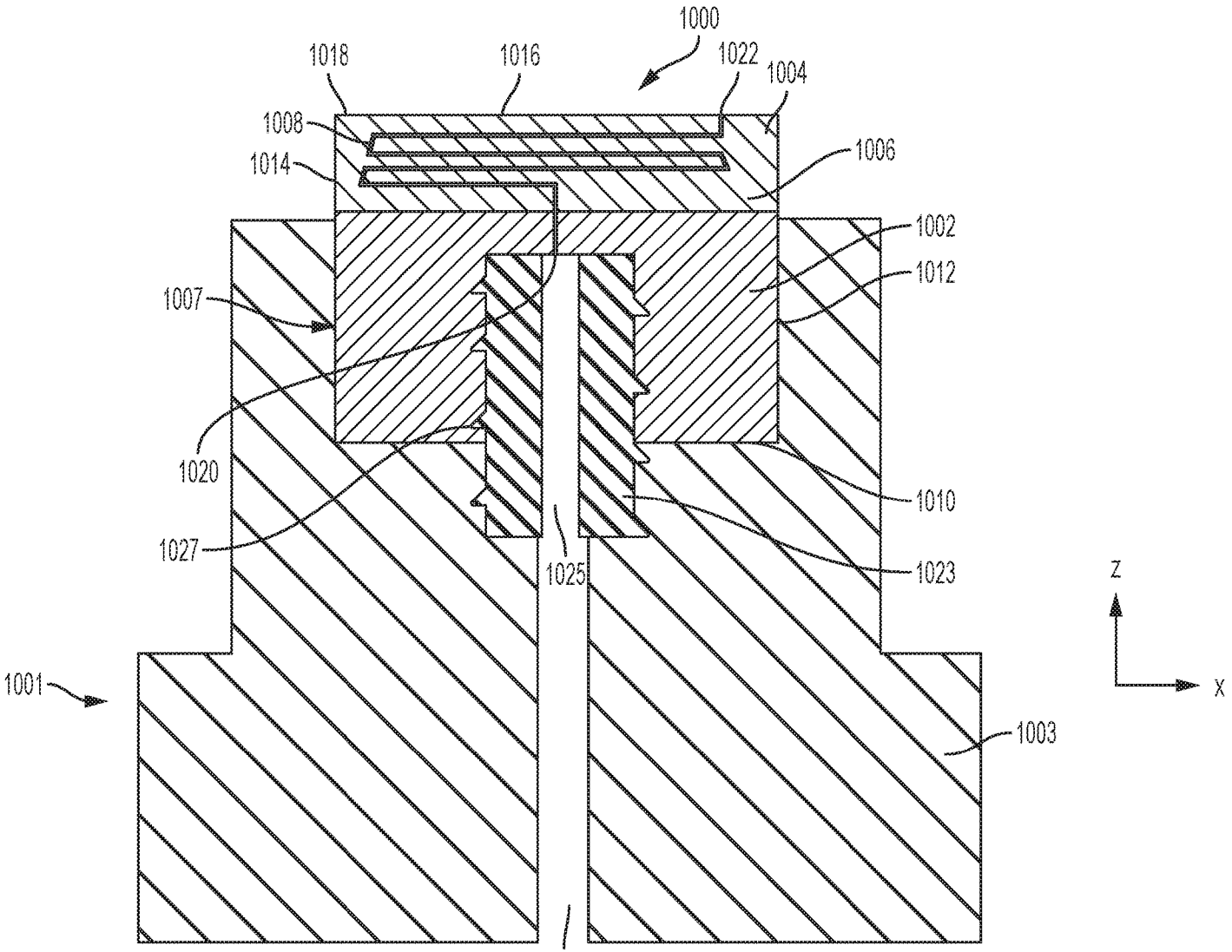

FIG. 10 illustrates a simplified partial cross-sectional view of another configuration for securing a cutting element of the disclosure to an earth-boring tool of the disclosure. As shown in FIG. 10, a cutting element 1000 including a supporting substrate 1002, a cutting table 1004 attached to the supporting substrate 1002 at an interface 1006, and at least one fluid flow pathway 1008 extending through the supporting substrate 1002 and the cutting table 1004 may be retained within a pocket 1007 in a bit body 1003 by way of a ridged structure 1023. The ridged structure 1023 may be disposed between the fluid flow pathway 1008 of the cutting element 1000 and a fluid flow pathway 1009 of the bit body 1003, and may include at least one fluid flow pathway 1025 extending completely therethrough. The ridged structure 1023 may, for example, comprise a hollow structure (e.g., a generally tubular structure, a generally annular structure) including one or more ridges 1027 (e.g., threads, barbs, rings) projecting therefrom. The ridged structure 1023 may be received and held within a recess in the supporting substrate 1002 adjacent the fluid flow pathway 1008 of the cutting element 1000, and may also be received and held within a recess in the bit body 1003 adjacent the fluid flow pathway 1009 of the bit body 1003. Surfaces of the supporting substrate 1002 and the bit body 1003 defining the recesses may include grooves therein complementary to and configured to receive the ridges 1027 of the ridged structure 1023. In some embodiments, the ridges 1027 of the ridged structure 1023 comprise threads configured to engage grooves in inner surfaces of the recesses in the supporting substrate 1002 and the bit body 1003. As shown in FIG. 10, the fluid flow pathway 1025 of the ridged structure 1023 is in fluid communication with each of the fluid flow pathway 1008 of the cutting element 1000 and the fluid flow pathway 1009 of the bit body 1003. An inlet 1020 of the fluid flow pathway 1008 of the cutting element 1000 may be at least partially (e.g., substantially) aligned with an outlet of the fluid flow pathway 1025 of the ridged structure 1023, and an inlet of the fluid flow pathway 1025 of the ridged structure 1023 may be at least partially (e.g., substantially) aligned with an outlet of the fluid flow pathway 1009 of the bit body 1003. The ridged structure 1023 may retain the cutting element 1000 within the pocket 1007 in the bit body 1003 without the use of a braze material. For example, the cutting element 1000 may be screwed into place within the pocket 1007 in the bit body 1003 using the ridged structure 1023. The ridged structure 1023 may be formed of any material compatible with the material compositions of the cutting element 1000 and the bit body 1003. In some embodiments, the ridged structure 1023 comprises a metal material (e.g., an alloy, elemental metal).

Figure 11:
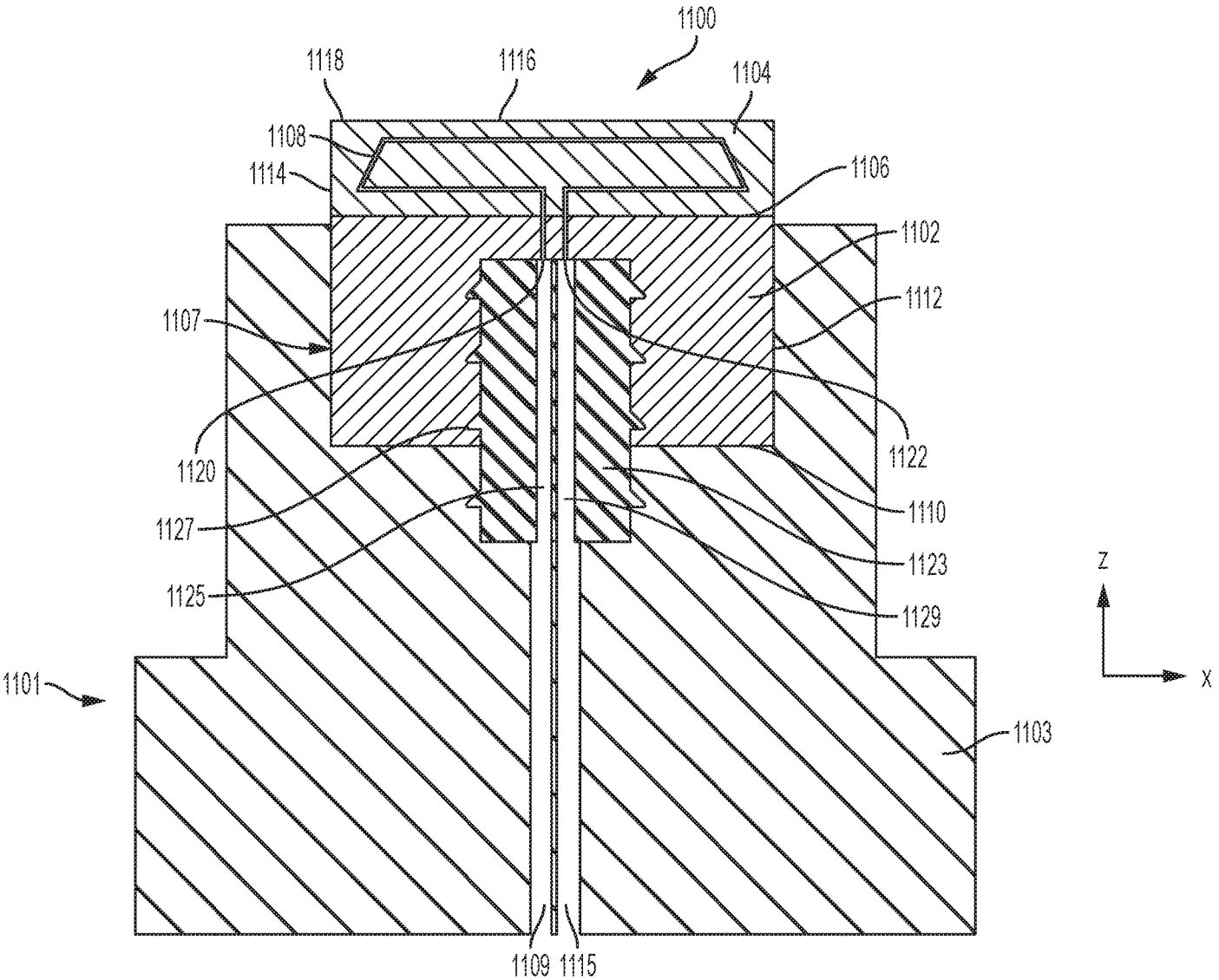

FIG. 11 illustrates a simplified partial cross-sectional view of another configuration for securing a cutting element of the disclosure to an earth-boring tool of the disclosure. As shown in FIG. 11, a cutting element 1100 including a supporting substrate 1102, a cutting table 1104 attached to the supporting substrate 1102 at an interface 1106, and at least one fluid flow pathway 1108 extending through the supporting substrate 1102 and the cutting table 1104 may be retained within a pocket 1107 in a bit body 1103 by way of a ridged structure 1123. The fluid flow pathway 1108 of the cutting element 1100 may exhibit a looped configuration similar to that of the fluid flow pathway 308 of the cutting element 300 previously described with reference to FIG. 3, such that each of an inlet 1120 and an outlet 1122 of the fluid flow pathway 1108 of the cutting element 1100 are located along a lower surface 1110 of the supporting substrate 1102 of the cutting element 1100. The fluid flow pathway 1108 of the cutting element 1100 is in fluid communication with each of a fluid flow pathway 1109 of the bit body 1103 and an additional fluid flow pathway 1115 of the bit body 1103. The ridged structure 1123 may be disposed between the fluid flow pathway 1108 of the cutting element 1100 and each of the fluid flow pathway 1109 and the additional fluid flow pathway 1115 of the bit body 1103. The ridged structure 1123 includes a fluid flow pathway 1125 and an additional fluid flow pathway 1129. The fluid flow pathway 1125 of the ridged structure 1123 extends from and between the fluid flow pathway 1109 of the bit body 1103 and the inlet 1120 of the fluid flow pathway 1108 of the cutting element 1100. An inlet of the fluid flow pathway 1125 of the ridged structure 1123 may be at least partially (e.g., substantially) aligned with an outlet of the fluid flow pathway 1109 of the bit body 1103, and an outlet of the fluid flow pathway 1125 of the ridged structure 1123 may be at least partially (e.g., substantially) aligned with the inlet 1120 of the fluid flow pathway 1108 of the cutting element 1100. The additional fluid flow pathway 1129 of the ridged structure 1123 extends from and between the outlet 1122 of the fluid flow pathway 1108 of the cutting element 1100 and the additional fluid flow pathway 1115 of the bit body 1103. An inlet of the additional fluid flow pathway 1129 of the ridged structure 1123 may be at least partially (e.g., substantially) aligned with the outlet 1122 of the fluid flow pathway 1108 of the cutting element 1100, and an outlet of the additional fluid flow pathway 1129 of the ridged structure 1123 may be at least partially (e.g., substantially) aligned with an inlet of the additional fluid flow pathway 1115 of the bit body 1103. The configuration shown in FIG. 11 may permit fluid (e.g., coolant fluid) directed into the fluid flow pathway 1108 of the cutting element 1100 from the fluid flow pathway 1109 of the bit body 1103 by way of the fluid flow pathway 1125 of the ridged structure 1123 to be directed into the additional fluid flow pathway 1115 of the bit body 1103 by way of the additional fluid flow pathway 1129 of the ridged structure 1123 after the fluid has been flowed through the fluid flow pathway 1108 of the cutting element 1100, thereby facilitating the recycle and reuse of the fluid. The ridged structure 1123 may retain the cutting element 1100 within the pocket 1107 in the bit body 1103 without the use of a braze material. The ridged structure 1123 may, for example, comprise a partially hollow structure including one or more ridges 1127 (e.g., threads, barbs, rings) projecting therefrom. The ridged structure 1023 may be received and held within a recess in the supporting substrate 1102 adjacent the fluid flow pathway 1108 of the cutting element 1100, and may also be received and held within a recess in the bit body 1103 adjacent each of the fluid flow pathway 1109 and the additional fluid flow pathway 1115 of the bit body 1103. Surfaces of the supporting substrate 1102 and the bit body 1103 defining the recesses may include grooves therein complementary to and configured to receive the ridges 1127 of the ridged structure 1123. In some embodiments, the ridges 1127 of the ridged structure 1123 comprise threads configured to engage grooves in inner surfaces of the recesses in the supporting substrate 1102 and the bit body 1103. For example, the cutting element 1100 may be screwed into place within the pocket 1107 in the bit body 1103 using the ridged structure 1123. The ridged structure 1123 may be formed of any material compatible with the material compositions of the cutting element 1100 and the bit body 1103. In some embodiments, the ridged structure 1123 comprises a metal material (e.g., an alloy, elemental metal).

With returned reference to FIG. 4, during use and operation, the rotary drill bit 401 may be rotated about a longitudinal axis thereof in a borehole extending into a subterranean formation. As the rotary drill bit 401 rotates, at least some of the cutting elements 400 provided in rotationally leading positions across the blades 405 of the bit body 403 may engage surfaces of the borehole with cutting edges thereof and remove (e.g., shear, cut, gouge, etc.) portions of the subterranean formation. In addition, as the rotary drill bit 401 rotates, fluid (e.g., coolant fluid) may be delivered into fluid flow pathways (e.g., the fluid flow pathways 108, 208, 308, 508, 608, 708, 808, 908, 1008, 1108 respectively shown in FIGS. 1 through 3 and 5 through 11) in the cutting elements 400 from fluid flow pathways (e.g., the fluid flow pathways 509, 609, 709, 809, 909, 1009, 1109 respectively shown in FIGS. 5 through 11) in the bit body 403. The fluid may flow through the fluid flow pathways in the cutting elements 400 to internally cool the cutting elements 400.

The cutting elements and earth-boring tools of the disclosure may exhibit increased performance, reliability, and durability as compared to conventional cutting tables, conventional cutting elements, and conventional earth-boring tools. The configurations of the cutting elements of the disclosure (e.g., including the configurations and positions of the fluid flow pathways thereof) advantageously facilitate efficient internal cooling of the cutting elements using fluid during the use and operation of the cutting elements. The cutting elements, earth-boring tools, and methods of the disclosure may provide enhanced drilling efficiency as compared to conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A method of forming a cutting element, comprising:

forming an assembly comprising a supporting substrate, a hard material powder over the supporting substrate, and an acid-dissolvable structure embedded within the supporting substrate and the hard material powder;

defining a geometry of a fluid pathway with the acid-dissolvable structure;

subjecting the supporting substrate, the hard material powder, and the acid-dissolvable structure to elevated temperatures and elevated pressures to inter-bond discrete hard material particles of the hard material powder and form a cutting table attached to the supporting substrate; and removing the acid-dissolvable structure from the cutting table and the supporting substrate forming the fluid pathway.

2. The method of claim 1, wherein forming an assembly comprises forming the acid-dissolvable structure to extend from a lower surface of the supporting substrate opposite an interface between the supporting substrate and the hard material powder to an upper boundary of the hard material powder opposite the interface between the supporting substrate and the hard material powder.

3. The method of claim 1, wherein forming an assembly comprises forming the acid-dissolvable structure to extend from a lower surface of the supporting substrate opposite an interface between the supporting substrate and the hard material powder, through portions of the supporting substrate and the hard material powder, and back to the lower surface of the supporting substrate.

4. The method of claim 1, wherein forming an assembly comprises selecting the acid-dissolvable structure to comprise greater than or equal to about 10 weight percent rhenium.

* * * * *